US005422545A

United States Patent [19]

Felper et al.

[11] Patent Number: 5,422,545

[45] Date of Patent: Jun. 6, 1995

[54] CLOSED LOOP FEEDBACK CONTROL CIRCUITS FOR GAS DISCHARGE LAMPS

[75] Inventors: Gerald A. Felper, Anaheim; Francis H. Gerhard, San Juan Capistrano, both of Calif.

[73] Assignee: Tek-Tron Enterprises, Inc., Irvine, Calif.

[21] Appl. No.: 109,090

[22] Filed: Aug. 19, 1993

[51] Int. Cl.[6] ..... H05B 37/02

[52] U.S. Cl. ..... 315/209 R; 315/247; 315/224; 315/307; 315/DIG. 5

[58] Field of Search ..... 315/209 R, 247, 224, 315/307, DIG. 5

[56] References Cited

U.S. PATENT DOCUMENTS

| | | | |
|---|---|---|---|
| 3,890,537 | 6/1975 | Park et al. | 315/208 |
| 4,230,971 | 10/1980 | Gerhard et al. | 315/307 |
| 4,346,331 | 8/1982 | Hoge | 315/158 |
| 4,382,210 | 5/1983 | Buhrer | 315/73 |
| 4,511,195 | 4/1985 | Barter | 315/308 |
| 4,649,320 | 3/1987 | Hough et al. | 315/100 |
| 4,870,327 | 9/1989 | Jorgensen | 315/307 |
| 4,914,335 | 4/1930 | Mertens et al. | 315/307 |
| 4,958,108 | 9/1990 | Jorgensen | 315/307 |
| 5,105,127 | 4/1992 | Lavaud et al. | 315/291 |
| 5,140,229 | 8/1992 | Yagi et al. | 315/307 |
| 5,198,726 | 3/1993 | Van Meurs et al. | 315/224 |
| 5,218,272 | 6/1993 | Jones | 315/247 |

*Primary Examiner*—Robert J. Pascal

*Assistant Examiner*—Reginald A. Ratliff

*Attorney, Agent, or Firm*—Knobbe, Martens, Olson & Bear

[57] ABSTRACT

A circuit for controlling low wattage gas discharge lamps comprised of a inductive coupling device, e.g., a transformer, a switching transistor, a current sensor, a comparator receiving a signal from the current sensor and driving the switching transistor, and a protective clamp circuit. The primary winding of the inductive coupling device receives a DC voltage and is also connected to the transistor. The transistor allows current to flow through the primary winding causing energy to be stored therein until the current sensor signals the comparator that a first threshold has been reached, the comparator then turns the switching transistor off and the inductive coupling device then enter a fly-back mode where the stored energy is applied to the lamp for a set period of time. The transistor then turns back on and this process is repeated so that the lamp receives a high frequency alternating voltage. The clamp circuit senses the voltage produced when the inductive coupling device enters the fly-back mode and, when this voltage reaches unsafe levels, the clamp circuit limits the energy stored in the inductive coupling device and thereby limits the voltage to a safe level. In one configuration, a boosting circuit is used to increase the first threshold to permit more energy to be stored in the primary winding and thereby increase the voltage applied to start the lamp.

38 Claims, 6 Drawing Sheets

CLOSED LOOP FEEDBACK CONTROL CIRCUITS FOR GAS DISCHARGE LAMPS

BACKGROUND OF THE INVENTION

1. Field of the Invention

This invention generally relates to an apparatus for operating a gas discharge lamp, such as a fluorescent lamp, and specifically is concerned with a control circuit for operating low wattage fluorescent lamps.

2. Description of the Related Art

Gas discharge lamps, specifically common fluorescent lamps, are essentially comprised of a gas filled tube having an electrode at either end of the tube. Application of a voltage to the electrodes results in some of the gases in the tube turning to plasma and causing the lamp to luminesce. There are three basic configurations of fluorescent lamps: instantaneous start, rapid start and pre-heat. Instantaneous start lamps are lamps which are started by the application of a voltage large enough to cause the gases within the tube to instantaneously luminesce. Rapid start lamps, however, have filaments which emit electrons into the tube while a voltage is applied to the lamp and thereby assist in inducing the gases to turn to plasma and causing the lamp to luminesce. Consequently, rapid starting lamps require lower starting voltages and less deterioration of the electrodes than an instantaneous start. Finally, a pre-heat lamp is a lamp which has a glow tube or other switch which applies a voltage potential to filaments within the tube in a similar manner as rapid start lamps, however, the switch only applies the voltage when the lamp has not started thereby conserving energy.

Typically, when any gas discharge lamp is luminescing, it develops a negative resistance, once the lamp has started. The voltage required to keep the lamp operating is less than the voltage required to start the lamp. One consequence of gas discharge lamps developing negative resistances is that they draw very large amounts of current unless they are ballasted or "current limited". A gas discharge lamp is typically ballasted by placing an impedance in series with the lamp that permits the operating voltage to be applied to the lamp, but otherwise limits the amount of current that is drawn into the lamp. Both inductive coupling devices, such as chokes, transformers, resistors or capacitors are used to provide this impedance depending on operating frequency or starting voltages.

Traditional line frequency ballasts, like chokes and transformers, often are prohibitively large and will not operate on direct current. Specifically, many low wattage applications of fluorescent lamps, such as lighting in vehicles, solar powered lighting, and battery or generator-powered lighting in third world countries, necessitate that the circuit energizing the lamp be very inexpensive and very small. Unfortunately, typical ballasting circuits used in conjunction with fluorescent lamps in buildings and supplied by line voltages, e.g., 120 VAC 60 Hz, are too large and operate with alternating current only. To minimize the space and cost requirements resulting from using large ballasting elements, control circuits for fluorescent lamps, including low wattage fluorescent lamps, have been developed which supply the lamp with a high frequency alternating voltage to minimize the size of the ballasting elements needed in the circuit.

One example of such a control circuit is shown in U.S. Pat. No. 4,230,971 to Gerhard, et al., issued Oct. 28, 1980. This control circuit includes an inductive coupling element, in this case a transformer, with the lamp connected across a secondary winding of the transformer. Further, one leg of a primary winding of the transformer is connected to a DC power source and the second leg of the primary winding is connected to the collector of a switching transistor.

The base of the switching transistor is connected to a one shot multi-vibrator driven by a comparator. The comparator compares the voltage at the emitter of the transistor to a variable reference voltage. The comparator, the one shot multi-vibrator and the switching transistor generate an oscillating voltage signal as the comparator periodically causes the one shot multi-vibrator to turn the switching transistor off for a set period of time thereby causing the transformer to periodically enter a fly-back mode for that period of time. When the transformer enters the fly-back mode, an opposite voltage is generated on the secondary winding, hence, by repeatedly causing the transformer to enter the fly-back mode, the lamp receives an alternating voltage. A further feature of the control circuit shown in U.S. Pat. No. 4,230,971 is that the reference voltage supplied to the comparator can be varied. Varying the reference voltage has the effect of varying the amount of power that is supplied to the fluorescent lamp. Consequently, with the circuit configuration shown in U.S. Pat. No. 4,230,971 a dimming function for a fluorescent lamp is achieved.

One difficulty associated with control circuits of this nature is that they still require external ballasting devices to be placed in series with lamp to limit the current drawn by the lamp when the lamp is luminescing and thereby protect the lamp. While alternating the voltage applied to the lamp minimizes the current that is drawn by the lamp, the lamp still has a negative resistance which causes the current to build up very quickly. Consequently, most control circuits that supply alternating voltages to the lamps still have ballasting elements in series with the lamps. Typically, in low wattage lamp circuits, the ballasting is provided by a resistor or capacitor. Ballasts of this type often have the unfortunate effect of consuming power. This consumption of power reduces the effectiveness of the lamp in situations where the power supply has a limited capacity, e.g., a battery.

A further difficulty with low wattage circuits providing an alternating voltage to the lamp is that they usually use either a fixed oscillator or a comparator-multivibrator circuit in conjunction with the inductive coupling element to provide the alternating voltage signal to the lamp. With this type of circuit, however, if there is a decrease in the supply voltage provided to the circuit, there is often a corresponding decrease in the voltage applied to the lamp which results in the lamp dimming or flickering.

Further, many low wattage lamps currently available have capacitances in parallel with the lamp. For example, most pre-heat lamps have a glow tube switch and an arc and noise suppression capacitor in parallel with the glow tube. The existence of these parallel capacitances necessitates the application of higher amplitude voltages to start the lamp when high frequency voltage signals are being used to energize a low wattage lamp of this type, as the parallel capacitances oppose the alternating changes in voltage and reduce the amount of power that is transmitted to the lamp. Using a fixed oscillator or a one-shot multi-vibrator to generate the voltage signal results in a fixed amount of energy being transmitted to the lamp. Hence, control circuits providing high frequency voltage signals to low wattage lamps of this type must continuously provide a sufficiently high voltage signal required to overcome these capacitances and start the lamp even after the lamp is operating. Since the lamp requires less energy to operate than it does to start, control circuits of this type are inefficient as they continuously provide the higher starting energy to the lamp and thus unnecessarily consume energy. In applications using low wattage lamps, this problem is accentuated as the power source is often a battery having a limited capacity for providing energy.

An additional problem with the above-described control circuits for low wattage lamps is that they typically do not incorporate any protection for the circuit components from voltages resulting from fault conditions. Specifically, if a lamp is removed from a typical circuit while the circuit is energized, a large voltage, that would otherwise be absorbed by the lamp, often results when the inductive coupling device enters the fly-back mode which could potentially damage the components of the circuit. Since the circuit that induces the inductive coupling element to enter the fly-back mode typically operates at a fixed frequency, there is no way to limit or clamp the amount of energy that is stored in the inductive coupling element to a safe level.

Hence, a need therefore exists in the prior art for a control circuit for low wattage gas discharge lamps that provides a high frequency alternating voltage to the lamp which does not require any additional external ballasting elements and can either increase or decrease the amount of energy provided to the lamp depending upon the condition of the lamp and supply voltage. To this end, there is a need in the prior art for an inexpensive control circuit which uses closed-loop feedback to control the amount of current that is being drawn by the gas discharge lamp when the lamp is operating to thereby eliminate the need for external ballasting. This control circuit should also be able to determine when the lamp is not being provided sufficient energy to start and can then increase the amount of energy provided to the lamp. Further, this control circuit should also be able to detect fault conditions where the resulting voltage in the circuit reach potentially damaging levels and can then decrease the amount of energy and current being produced by the circuit to thereby protect circuit components.

SUMMARY OF THE INVENTION

The aforementioned needs are satisfied by the circuit of the present invention which is essentially comprised of an inductive coupling device, a switching device, a first comparing device, which controls the switching device, and a current sensor. The gas discharge lamp is connected to the inductive coupling device, which can be comprised of either an auto-transformer or a transformer, which also receives a voltage from a power source.

Further, the inductive coupling device is also connected to the switching device, which can be a transistor, such that when the switching device is on, current flows through the inductive coupling device causing energy to be stored therein. When the switching device is turned off, the inductive coupling device enters a fly-back mode where the energy stored therein is applied across the electrodes of the lamp.

Closed-loop feedback and control of the energy and current being applied to the lamp during fly-back of the inductive coupling device is provided by the current sensor and the first comparing device. The current sensor samples the energy that is being stored in the inductive coupling device and when this energy reaches a threshold amount the current sensor and the first comparing device cause the switching device to turn off, forcing the inductive device into the fly-back mode. In this fashion, the amount of starting energy and operating current supplied to the lamp can be limited to what is necessary to operate the lamp thereby eliminating the need for external ballasting devices.

Another aspect of the control circuit of the present invention is a protective clamp circuit which samples the voltage produced when the inductive coupling device is in the fly-back mode. When the protective clamp circuit detects that this voltage has reached a threshold level where the voltage could potentially damage the components of the circuit, the protective clamp circuit, in conjunction with the first comparing device, induces the switching device remain on and charge the inductive device for a shorter period thereby limiting the amount of energy that will be discharged the next time the inductive coupling device enters the fly-back mode.

A further aspect of the present invention is a boost circuit which samples the voltage applied to the lamp and, when this voltage indicates that the lamp has not been started, the boost circuit, in conjunction with the first comparing device induces the switching device to remain on for a longer period of time thereby increasing the amount of energy stored in the inductive coupling device. The next time the inductive coupling device enters the fly-back mode, more stored energy and a greater voltage potential is applied to the lamp which then starts the lamp. Once the lamp has started, the boost circuit samples a low voltage due to the lamp's negative resistance. Consequently, the boost circuit is disabled and the control circuit draws less power to operate the lamp. In one specific application of the present invention, the boost circuit is used to start lamps that have capacitances in parallel with the lamp tube, such as pre-heat type lamps with built-in starters.

These and other objects and features of the present invention will become more fully apparent from the following description and the appended claims taken in conjunction with the accompanying drawings.

DETAILED DESCRIPTION OF THE PREFERRED EMBODIMENTS

Reference is now made to the drawings wherein like numerals refer to like parts throughout. The basic configuration and operation of one preferred circuit of the present invention configured to energize a low wattage fluorescent lamp equipped with an arc suppression capacitor and a starting glow switch will initially be described in reference to FIGS. 1–4. The basic configuration and operation of a second modified circuit of the present invention configured to operate multiple low wattage fluorescent lamps which are not equipped with the glow tube switches or a suppression capacitor will then be described in reference to FIGS. 5 and 6.

CIRCUIT CONFIGURATION FOR PRE-HEAT TYPE LAMP WITH BUILT-IN STARTER

Figure 1:
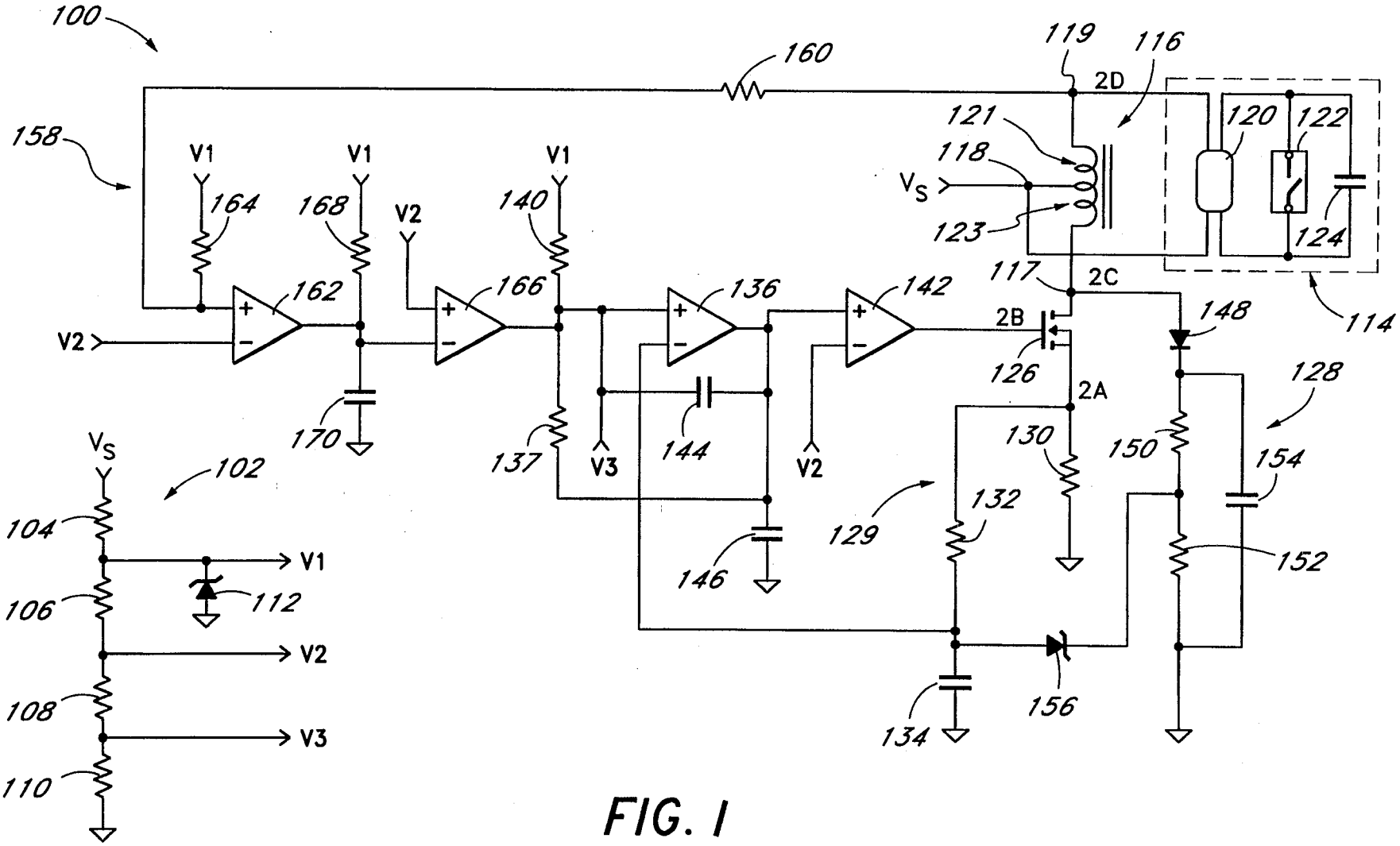
FIG. 1 illustrates an embodiment of a control circuit configured for a single pre-heat type fluorescent lamp shown in simplified form for facilitating an understanding of the overall function of the control circuit.

Referring now to FIG. 1, the control circuit 100 includes a voltage divider network 102 which is preferably comprised of four resistors 104, 106, 108 and 110 connected in series. The voltage divider network 102 receives a direct current (DC) voltage $V_s$ from an external power supply. A reference voltage $V_1$ is then produced in the network at the point between the resistors 104 and 106 and a reference zener diode 112 is preferably connected between $V_1$ and ground. The network 102 further produces a reference voltage $V_2$ between the resistors 106 and 108 and a reference voltage $V_3$ between the resistors 108 and 110. The reference voltages $V_1$–$V_3$ are all referenced by the zener diode 112 and are then used in the control circuit 100 as threshold voltages for the comparators, as will be described below.

A gas discharge lamp 114 is preferably connected to the secondary winding 121 of an auto-transformer 116, between a center-tap 118 and a second leg 119. The lamp 114 shown in FIG. 1 is preferably a low wattage lamp, e.g., a 13 W, pre-heat type fluorescent lamp of a type commonly available, such as DULUX-S compact fluorescent lamp manufactured by Osram Corp. of New York. The lamp 114 is comprised of a fluorescent tube 120 connected in parallel with a glow tube switch 122, for pre-heating the electrodes of the tube 120 to permit easier starting, and an arc and noise suppression capacitor 124. The tap 118 of the auto-transformer 116 preferably receives the DC supply voltage $V_s$ from a power supply circuit (not shown).

A first leg 117 of the auto-transformer 116 is preferably connected to the drain of a switching transistor 126 and is also connected to a protective clamp circuit generally indicated by 128. Consequently, a primary winding 123 of the auto-transformer 116 is connected to both the switching transistor 126 through the first leg 117 and the DC power supply providing $V_s$ (not shown) through the tap 118. The source of the switching transistor 126 is preferably connected to ground through a current sensor 129 comprised of a resistor 130, a resistor 132 and a capacitor 134. The current sensor 129 provides a measurement of the current that flows through the primary winding of the auto-transformer 116 when the switching transistor 126 is on. This current builds a proportionate voltage on the capacitor 134 which is then applied to an inverting (−) input of a comparator 136. The non-inverting (+) input of the comparator 136 is preferably connected to the voltage divider network 102 so that it receives both the reference voltage $V_1$, through a resistor 40, and the reference voltage $V_3$.

The output of the comparator 136 is fed into the non-inverting (+) input of a buffer comparator 142 which is also connected to ground through a capacitor 146. A hysteresis feedback loop comprised of a capacitor 144 and a resistor 137, is also connected between the output and the non-inverting (+) input of the comparator 136. The inverting input (−) of the buffer comparator 142 receives the reference voltage $V_2$ from the voltage divider network 102. The output of the buffer comparator 142 is then connected to the gate of the switching transistor 126.

Figure 2:
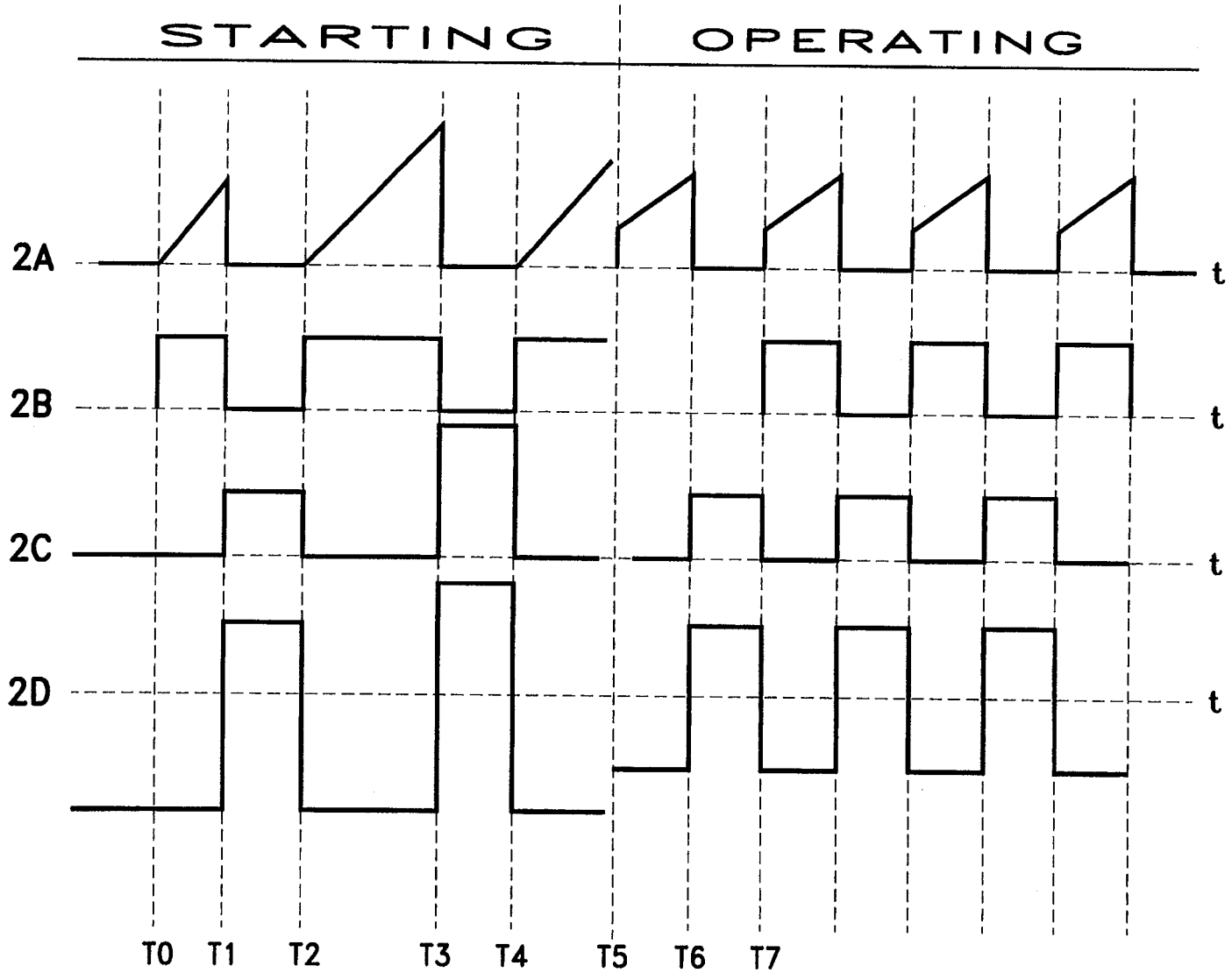
FIG. 2 shows four waveform plots labeled 2A, 2B, 2C and 2D, which are characteristic of the control circuit shown in FIG. 1 and which are used to illustrate the operation of the control circuit when it is in both a starting mode and an operating mode.

The switching transistor 126, the current sensor 129, the comparator 136 and the auto-transformer 116 form the basic components of a closed-loop feedback controlled oscillator which produces an alternating voltage signal, shown in waveform 2D in FIG. 2, which is applied to the lamp 120. The oscillator operates essentially as follows. When the transistor 126 is on, a negative voltage is applied to the lamp 120 and current flows into the current sensor 129. The current through the primary winding 123 of the auto-transformer 116 charges the capacitor 134 in the current sensor 129 until the capacitor 134 has a voltage sufficient to cause the comparator 136 to output a low signal and turn the transistor 126 off. When the transistor 126 is turned off, the auto-transformer 116 enters a fly-back mode where it discharges energy stored in the primary winding 121 to the secondary winding 123 and thus to the lamp 120 resulting in the application of a positive voltage to the lamp 120. Subsequently, the comparator 136 turns the transistor 126 back on because of the hysterisis circuit, and current again begins to flow through the primary winding 121 of the auto-transformer 116, causing a negative voltage to be applied to the lamp 120, and into the current sensor 129 where the capacitor 134 is again charged. In this fashion, the auto-transformer 116, the switching transistor 126, the current sensor 129 and the comparator 136 result in the application of an alternating voltage to the lamp 120. As will be described in greater detail below, the components of this closed-loop oscillator are selected so that an appropriate operating voltage is applied to the lamp 120 without requiring the addition of any external ballasts to the circuit 100.

An additional feature of the control circuit 100 is the protective clamp circuit 128 connected to first leg 117 of the auto-transformer 116. The protective clamp circuit 128 is comprised of a diode 148, the cathode of which is connected to a voltage divider network comprised of a pair of resistors 150 and 152, in series, and a capacitor 154 in parallel with the resistors 150 and 152. The cathode of a zener diode 156 is connected between the resistors 150 and 152 of the voltage divider, and the anode of the zener diode 156 is connected to the inverting (−) input of the comparator 136. When the lamp 120 has been started and is luminescing, the clamp circuit 128 receives a feedback voltage signal from both the auto-transformer 116 and from the lamp 120 each time the auto-transformer enters the fly-back mode as shown in waveform 2C in FIG. 2 below. The voltage signal from the auto-transformer 116 is representative of the total voltage seen at the drain of the transistor 126 when the auto-transformer 116 enters the fly-back mode. The protective clamp circuit 128 serves to protect the components, and in particular the transistor 126, of the control circuit 100 from the large voltage that result when the lamp 120 is either broken or otherwise removed from the circuit 100 while the circuit 100 is operating. The operation of the protective clamp circuit 128 will be described in greater detail in reference to FIG. 3 below.

A further feature of the circuit 100 is the boost feedback circuit 158 which samples the voltage on the second leg 119 of the auto-transformer 116 and feeds this voltage through a resistor 160 to the non-inverting (+) input of a comparator 162. The non-inverting (+) input of the comparator 162 also receives the reference voltage $V_1$ provided by the voltage divider network 102 through a resistor 164. The inverting (−) input of the comparator 162 receives the reference voltage $V_2$. The output of the comparator 162 is fed into the inverting (−) input of a buffer comparator 166. The inverting (−) input of the buffer comparator 166 also receives the reference voltage $V_1$ through a resistor 168 and is connected to ground via a capacitor 170. The non-inverting (+) input of the buffer comparator 166 is connected to the threshold voltage $V_2$ provided by the voltage divider network 102. The output of the buffer comparator 166 is connected to the non-inverting (+) input of the comparator 136.

The boost feedback circuit 158 samples the voltage being applied to the lamp 120. When the lamp 120 has not yet started, a large voltage is seen on the second leg 119 of the auto-transformer 116 when the auto-transformer 116 is in the fly-back mode. The values of the components comprising the boost feedback circuit 158 are selected so that when the lamp 120 has not started the large voltage on the second leg 119 is sufficient to cause the boost comparator 162 to output a high signal. This high signal is fed through the buffer comparator 166 to the non-inverting (+) input of the comparator 136. The capacitor 134 must then charge to a higher voltage when the switching transistor 126 is on to overcome the threshold voltage increased by the high output of the comparator 162 on the non-inverting (+) input of the comparator 136 and to thereby cause the comparator 136 to output a low signal and turn the switching transistor 126 off.

Consequently, when the boost circuit 158 is providing a high signal to the comparator 136, more current flows through the primary winding of the auto-transformer 116 causing more energy to be stored therein. Thus, when the transistor 126 is turned off, the amount of stored energy applied to the lamp 120 when the auto-transformer 116 enters the fly-back mode is increased as a result of the boost feedback circuit 158.

Once the lamp 120 has been started however, the magnitude of the voltage on the leg 119 of the auto-transformer 116 is very low as the lamp 120 preferably has a negative resistance when it is operating. Hence, the boost comparator 162 remains off and does not produce a high output. Thus, when the lamp 120 is operating the threshold voltage on the non-inverting input (+) of the comparator 136 is smaller permitting the capacitor 134 to turn the comparator 162 and the transistor 126 off sooner. Preferably, when the lamp 120 is operating, the control circuit 100 minimizes the amount of power to the amount needed to operate the lamp 120.

OPERATION OF THE PRE-HEAT TYPE LAMP CIRCUIT CONFIGURATION

The overall operation of the circuit 100 shown in FIG. 1 will now be described in greater detail in reference to FIGS. 2 and 3. FIG. 2 has four simplified exemplary waveforms illustrating the voltage and current signals over time as seen at various points in the circuit 100 while the circuit 100 is in both the starting and the operating modes. These waveforms are vertically juxtaposed and share a common time line to aid in comparison between the waveforms. Waveform 2A illustrates the waveform of the current signal received by the current sensor 129 at the source of the switching transistor 126 which proportionately builds a voltage on the capacitor 134 through the resistor 132. Waveform 2B illustrates the voltage signal applied by the comparator 136 through the buffer comparator 142 to the gate of the switching transistor 126. Waveform 2C illustrates the resulting voltage signal on the drain of the switching transistor 126 and the first leg 117 of the auto-transformer 116. Finally, waveform 2D illustrates the resulting voltage signal that is applied to the lamp 120.

When the circuit 100 is initially turned on at time $T_0$, the external voltage supply supplies the DC voltage $V_s$ to the voltage divider network 102 and to the center tap 118 of the auto-transformer 116. The circuit 100 is now in a starting mode where it attempts to start the lamp 120. Here, the comparator 136 initially outputs a high signal, as shown in waveform 2B, turning on the switching transistor 126 causing current to flow through the primary winding of the auto-transformer 116, the transistor 126 and the current sensor 129. This current begins to ramp up, as shown in waveform 2A, and it also simultaneously builds a proportional voltage on the capacitor 134 in the current sensor 129 and causes proportional energy to be stored in the primary winding 123 of the auto-transformer 116. The voltage being applied to the lamp 120 at this time is a negative voltage as shown in waveform 2D. The magnitude of the voltages applied to the lamp 120 is dependent upon the turns ratio of the auto-transformer 116 which has preferably been selected to supply a voltage sufficient to efficiently operate the lamp 120.

Once the current has charged the capacitor 134 to a voltage greater than the voltage being applied to the non-inverting (+) input of the comparator 136, which occurs at time $T_1$, the output of the comparator 136 (waveform 2B) goes low and the switching transistor 126 is turned off. This results in the current sensed by the current sensor 129 rapidly collapsing to zero (waveform 2A). Once the comparator 136 outputs a low voltage, the comparator 136 enters a hysteresis loop which causes the comparator 136 to continue to produce a low voltage for a fixed period of time which is dependent upon the component values for the components comprising the hysterisis loop.

When the switching transistor 126 is turned off, the auto-transformer 116 enters the fly-back mode where energy stored in the primary winding 123 is discharged to the secondary winding 121. Consequently a large positive voltage is applied across the electrodes of the lamp 120. As shown in waveform 2D, the auto-transformer 116 continues to supply this increasing high positive voltage until the switching transistor 126 is turned back on by the comparator 136 at time $T_2$.

The switching transistor 126 is turned back on at time $T_2$ once the voltage from the hysteresis loop rises above the voltage at the capacitor 134. At time $T_2$, the switching transistor 126 again turns on and current begins flowing through the auto-transformer 116, the switching transistor 126 and the current sensor 129 in the previously described fashion.

However, if the lamp 120 did not start when the positive fly-back voltage was applied between times $T_1$ and $T_2$, the boost circuit 158 senses a sufficiently large positive voltage on the lamp 120 to cause the comparator 162 to produce a high output signal. The high output signal is then applied, through the buffer comparator 166, to the non-inverting (+) input of the comparator 136. Hence, the threshold voltage applied to the non-inverting (+) input of the comparator 136 is increased by the output of the boost comparator 162. The output of the comparator 162 remains high for a fixed time period which is dependent on the discharge rate of the capacitor 170. Preferably the capacitor 170 supplies a sufficiently high voltage to increase the threshold voltage on the non-inverting (+) input of the comparator 136 until the capacitor 134 in the current sensor 129 builds a sufficient voltage to overcome the heightened threshold voltage. Thus, the transistor 126 remains on for a longer period of time, until time $T_3$, as the capacitor 134 takes longer to charge to the heightened threshold voltage to cause the comparator 136 to turn the transistor 126 off. Consequently, as shown in waveform 2A, current flows through the primary winding 123 of the auto-transformer 116 for a longer period of time which results in a greater amount of energy being stored in the primary winding 121 of the auto-transformer 116.

At time $T_3$, the comparator 136 turns the switching transistor 126 off and the auto-transformer 116 enters the fly-back mode where the energy stored in the primary winding 123 between times $T_2$ and $T_3$ is applied across the electrodes of the lamp 120 until time $T_4$ when the hysterisis loop of the comparator 126 causes the comparator 126 to output a high voltage again (waveform 2B). Hence, a positive voltage of a larger magnitude is applied to the electrodes of the lamp 120 between the times $T_3$ and $T_4$ than was applied between the times $T_1$ and $T_2$ as shown in the waveform 2D. Preferably, the component values of the boost circuit 158 and the auto-transformer 116 are selected so that the magnitude of the heightened voltage is sufficient to start the lamp 120. If, however, the lamp 120 does not start, the control circuit 100 continues to periodically apply a boosted starting voltage to the electrodes of the lamp 120 in the above-described fashion until the lamp 120 does start.

Once the lamp 120 has started, the circuit 100 initiates an operating mode. In the operating mode, the circuit 100 and the auto-transformer 116 preferably operate in a feed forward mode as follows. The comparator 136 outputs a high voltage, as shown in waveform 2B, causing the switching transistor 126 to turn on at a time $T_5$, allowing current to flow through the primary winding 123 of the auto-transformer 116 and the current sensor 129, until the current builds a sufficient voltage on the capacitor 134 to overcome the threshold voltage on the non-inverting (+) input of the comparator 136 at time $T_6$. During this period, the current through the primary winding 123 ramps up, as shown in waveform 2A, and the voltage applied to the lamp 120 is negative as shown in waveform 2D.

Once capacitor 134 has a sufficient voltage to cause the comparator 136 to turn the transistor 126 off at time T6, the auto-transformer 116 enters the fly-back mode where it discharges the energy stored between times $T_5$ and $T_6$ and thereby applies a positive voltage to the lamp 120, as is shown in waveform 2D. The auto-transformer 116 continues to supply positive voltage to the lamp 120 until a time $T_7$ where the hysteresis loop connected to the comparator 136 cause the comparator 136 to generate a high output and turn the switching transistor back on.

When the lamp 120 is operating, the boost feedback circuit 158 is disabled as the voltage appearing on the leg 119 of the auto-transformer 116 is low due to the low resistance characteristics of the operating lamp. Hence, the capacitor 134 does not need to draw as much current to build a voltage sufficient to force the comparator 136 to turn the switching transistor 126 off and drive the auto-transformer 116 into the fly-back mode. Consequently, the power consumed by the circuit 100 is reduced once the lamp 120 has been started to only what is necessary to continue operation of the lamp 120.

Further, when the lamp 120 is operating, the current that must be drawn from the external power source to charge the capacitor 134 to the threshold level is reduced as current is now flowing through the lamp 120 and this current appears at the current sensor 129 when the switching transistor 126 is turned on. Waveform 2A illustrates the effect of this current in that at times $T_5$ and $T_7$ the current seen by the current sensor 129 instantaneously jumps from zero to an initial level which is representative of the reflected current that is flowing through the lamp 120. The current then builds so that the capacitor 134 attains the threshold level of voltage to induce the comparator 136 to turn the switching transistor 126 off at time $T_6$ thereby causing the auto-transformer 116 to enter the fly-back mode.

FIG. 2 illustrates that when the lamp 120 is operating and luminescing, an alternating voltage signal is applied to the lamp 120. Preferably, the control circuit 100 generates a signal having a sufficiently high frequency such that the negative resistance characteristic of the lamp 120 does not have sufficient time in a single half-cycle to draw enough current to damage the electrodes of the lamp 120. In this way, the control circuit 100 can eliminate the need for external ballasting of the lamp 120.

The circuit 100 consequently provides an alternating voltage signal to the lamp 120 having a variable on-time and a fixed off time. The variable on-time, or the time at which the auto-transformer 116 enters the fly-back mode and applies a positive voltage to the lamp 120, depends upon the variable threshold level that the capacitor 134 must reach to induce the comparator 136 to turn the switching transistor 126 off. Conversely, the off-time of the voltage signal, or the time at which the comparator 136 turns the transistor 126 back on causing the auto-transformer 116 leaving the fly-back mode, is fixed by the hysterisis loop of the comparator 136.

This configuration of the circuit 100 allows for greater flexibility as the on-time can be changed depending upon the condition of the lamp 120 or upon the condition of the circuit 100. Consequently, the amount of energy stored in the primary winding 123 of the auto-transformer 116 which is subsequently applied to the lamp 120 when the auto-transformer 116 enters the fly-back mode can also be changed for different conditions of the lamp.

Specifically, as illustrated with the boost feedback circuit 158, the on-time can be lengthened, and the energy stored in the auto-transformer 116 can be increased by increasing the threshold voltage level that the capacitor 134 must charge to induce the comparator 136 to turn the switching transistor 126 off. The converse is also true, in that decreasing the voltage that the capacitor 134 must build by receiving current through the transistor 126, e.g., by supplying additional current to the capacitor 134 from a different source than the transistor 126 or an additional voltage source to the inverting (−) input of the comparator 136, results in shortening the on-time and thereby reducing the energy that is stored in the auto-transformer 116.

Further, using closed-loop feedback in this fashion to control the amount of energy stored in the primary winding 123 of the auto-transformer 116 makes the control circuit 100 less sensitive to changes in the external voltage supply $V_s$ over a given range. Specifically, the circuit 100 can still provide sufficient power to the lamp 120 for the lamp 120 to luminesce without dimming or flickering even if there is a change in the supply voltage $V_s$. If the voltage $V_s$ decreases, the on-time of the alternating voltage signal is increased as it now takes the capacitor 134 longer to charge to the threshold voltage needed to force the auto-transformer 116 into the fly-back mode. During this period, the power supplied to the lamp 120 is increased due to the decrease in the supply voltage $V_s$ and the frequency of the alternating voltage signal is also decreased.

However, the energy stored in the primary winding 123 of the auto-transformer 116 remains the same and when the auto-transformer 116 enters the fly-back mode, the energy received by the lamp 120 is the same as it would be when the supply voltage $V_s$ was its optimum value. Hence the sensitivity of the circuit 100 to changes in the supply voltage is reduced as the circuit 100 can still provide the optimum power to the lamp 120 when the auto-transformer 116 enters the fly-back mode. In the embodiment of the circuit 100 shown in FIG. 1, the circuit 100 can be configured to provide an alternating voltage sufficient to operate the lamp 120 without any dimming or flickering over a range of supply voltages $V_s$ of approximately 9 to 14 volts DC.

Figure 3:
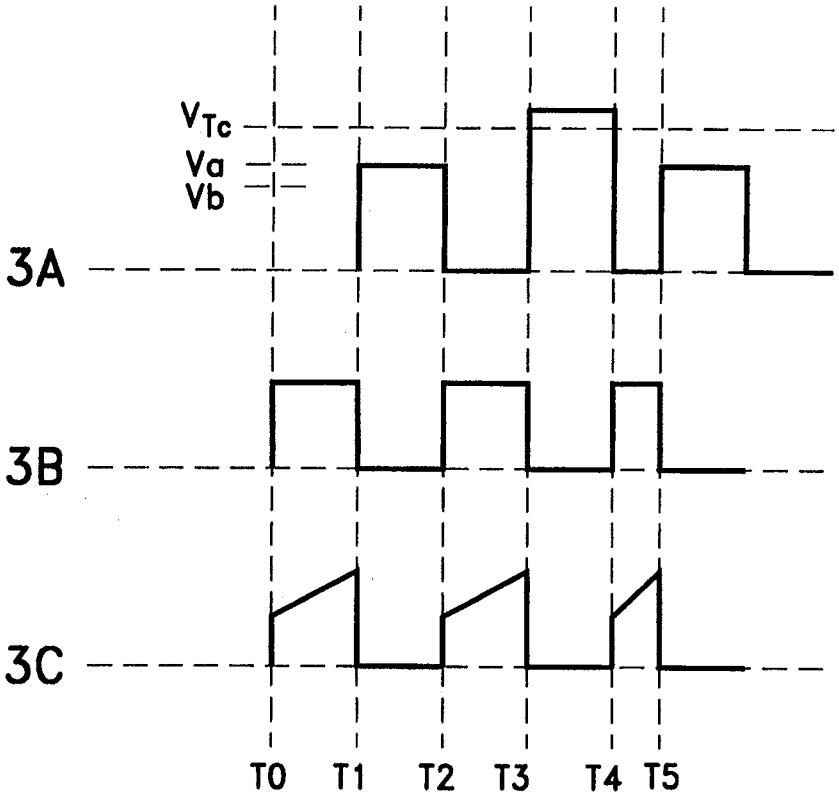
FIG. 3 shows three waveform plots labeled 3A, 3B and 3C which are characteristic of the control circuit shown in FIG. 1 and which are used to illustrate the operation of the protective clamp circuit shown therein.

FIG. 3 has three exemplary waveforms which are used to illustrate the operation of the protective clamp circuit 128. The protective clamp circuit 128 uses closed-loop feedback to limit or clamp the voltage generated by the circuit 100 to within safe levels. Waveform 3A illustrates the voltage at the protective clamp circuit 128 on the second leg 117 of the auto-transformer 116 while the lamp 120 is in the operating mode. Waveform 3B illustrates the voltage applied to the gate of the switching transistor 126 and waveform 3C illustrates the resulting current that would be seen by the current sensor 129.

The purpose of the protective clamp circuit 128 is to ensure that the voltage in the circuit 100 is limited to within safe levels. When the lamp 120 is energized, the maximum voltage occurs when the auto-transformer 116 enters the fly-back mode. If, for example, the lamp 120 is removed from the circuit 100 and the auto-transformer 116 enters the fly-back mode, a large voltage would be generated which could conceivably damage the components of the circuit 100 specifically, the transistor 126.

Referring specifically to waveform 3A, when the auto-transformer enters the fly-back mode at time $T_1$, a voltage having a magnitude of $V_a$ is seen by the clamp circuit 128. If the voltage $V_a$ is less than the threshold voltage $V_{tc}$ needed to cause the clamp circuit 128 to forward bias the zener diode 156, then the protective clamp circuit 128 does not operate. If, however, the lamp 120 is removed from the circuit 100 between times $T_2$ and $T_3$, a large voltage appears on the first leg 119 of the auto-transformer 116 when the auto-transformer 116 enters the fly-back mode again at time $T_3$. In waveform 3A this voltage is greater than the threshold voltage $V_{tc}$ needed to forward bias the zener diode 156, thus, the zener diode 156 is forward biased and the resulting avalanche current causes the capacitor 134 to charge to a first voltage level. The value of the threshold voltage $V_{tc}$ is dependent upon the voltage divider network comprised of the resistors 150 and 152.

At time $T_4$ when the comparator 136 turns the switching transistor 126 back on, the capacitor 134 has already charged to the first voltage level as a result of having received the avalanche current from the zener diode 156. Hence, the capacitor 134 takes less time to build to the threshold voltage required to turn the comparator 136 off when current is flowing through the auto-transformer 116. Hence, current flows through the primary winding 123 of the auto-transformer 116 for a shorter period of time resulting in less energy being stored therein. Consequently, the auto-transformer 116 supplies less fly-back energy when the switching transistor 126 is turned off at time $T_5$ resulting in a lower voltage $V_b$ on the leg 119 seen by the clamping circuit 128, as is shown by waveform 3A. In this fashion the voltage in the circuit 100 produced during fly-back of the auto-transformer 116 can be clamped to within a safe margin.

DETAILED IMPLEMENTATION OF CIRCUIT CONFIGURATION FOR PRE-HEAT TYPE LAMP

Figure 4:
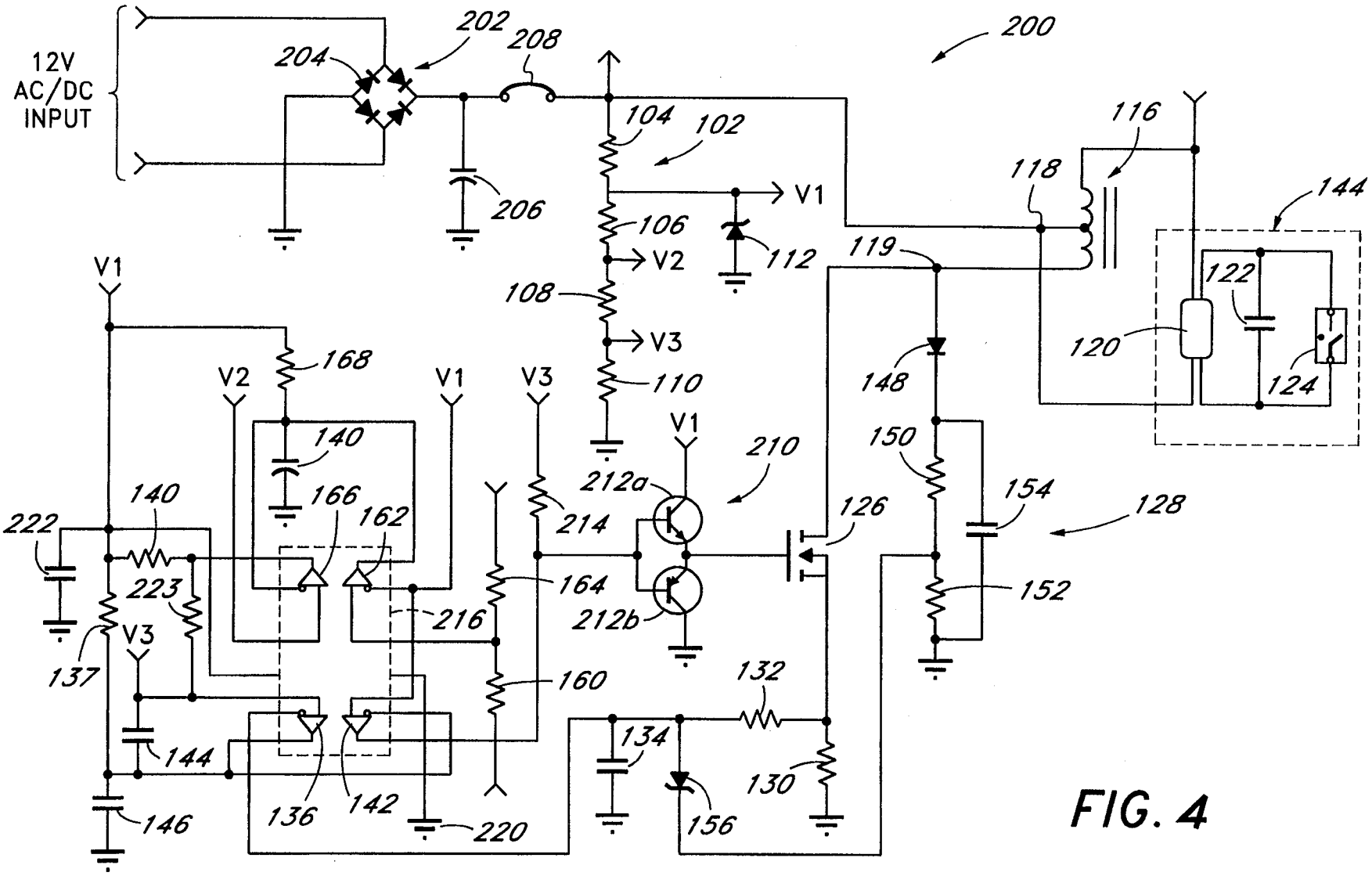
FIG. 4 is a detailed circuit schematic corresponding to the control circuit shown in FIG. 1, which includes circuitry for a closed-loop feedback controlled oscillator, a closed-loop feedback controlled boost circuit for starting the lamp, and a closed-loop feedback controlled protective clamp circuit.

The foregoing section describes a simplified embodiment of the control circuit of the present invention and its operation. FIG. 4 illustrates a circuit 200 in more detail the implementation of the circuit of the present invention corresponding to the circuit 100 shown in FIG. 1. The circuit 200 includes all of the basic features of the circuit 100 as well as some additional components which enhance the circuit's performance.

One of the additional components of the circuit 200 is a rectifier circuit 202 which is comprised of a diode bridge 204 and a filter capacitor 206. The rectifier circuit 202 preferably receives a DC or AC voltage input from an external power supply such as a battery. The rectifier circuit 202 then supplies the DC voltage $V_s$, through a thermal switch 208 to both the voltage divider network 102 and the center tap 118 of the auto-transformer 116. By including a rectifier circuit 202, the circuit 200 can be connected to either AC or DC power supplies, and the polarity of the DC supply may be reversed, thereby enhancing the versatility of the circuit 200. Preferably, the circuit 200 receives a 12 Volt AC or DC voltage, however, the circuit configuration can actually be used to start and operate the lamp 120 over a wider range of voltages from approximately 9 to 14 volts as previously described.

The thermal switch 208 in the circuit 200 is a commonly available thermal switch and it is preferably set to disconnect the power supply from the voltage divider network 102 and the center-tap 118 of the auto-transformer 116 when the temperature in the circuit reaches 100° C. Consequently, the thermal switch 208 provides additional protection for the components of the circuit 200 as heat is typically generated where large currents result from an open circuit or short circuit condition. Thus, the thermal switch 208 protects the components of the circuit 200 from damage from these currents by disconnecting the power supply from the circuit when an elevated temperature indicative of a fault condition is detected.

Another additional feature included in the circuit 200 is an emitter-follower pair 210 comprised of a pair of bipolar transistors 212*a* and 212*b*, having a common emitter and a common base, and a biasing resistor 214. The common base of the emitter-follower pair 210 is connected to the output of the buffer comparator 142 and the common emitter is connected to the gate of the switching transistor 126. The emitter-follower pair 210 alternately injects current into the base of the switching transistor 126 to quickly switch the transistor 126 from the off position to the on position and removes current from the base of the switching transistor 126 to quickly switch the transistor 126 from the on position to the off position. Consequently, the emitter-follower pair 210 enhances the switching speed of the circuit 200 and reduces switching losses thereby regulating heat in the transistor 126.

A final additional feature included in the circuit 200 is that the comparators 136, 142, 162 and 166 are all contained on a single integrated circuit 216, preferably a commonly available type LM339 integrated circuit. The integrated circuit has a ground connection 220 and is also connected to the threshold voltage $V_1$ provided by the voltage divider network 102 with a capacitor 222 connected between the threshold voltage $V_1$ and ground. The integrated circuit 216 requires less space and permits easier manufacturing than using individual comparators in the circuit 200.

The circuit 200 shown in FIG. 3 is configured to operate in the manner previously described in reference to FIGS. 2 and 3. One preferred implementation of the above-described circuit which operates in the above-described manner consists of the circuit configuration shown in FIG. 4 with the components values given by Table 1 below.

TABLE 1

| NUMBER | DEVICES | PART NO. | VALUES |
|---|---|---|---|
| 104 | Resistor | | 220Ω |
| 106 | Resistor | | 15kΩ |
| 108 | Resistor | | 15kΩ |
| 110 | Resistor | | 820Ω |
| 112 | Zener Diode | 1N4739 | |
| 116 | Auto-Transformer | | |
| 126 | Mosfet Transistor | 1RF630 | |
| 130 | Resistor | | .1Ω |
| 132 | Resistor | | 200 |
| 134 | Capacitor | | .01 μF |
| 137 | Resistor | | 12kΩ |
| 140 | Resistor | | 8.2kΩ |
| 144 | Capacitor | | 100 μF |
| 146 | Capacitor | | 1nF |
| 148 | Diode | 1N4936 | |
| 150 | Resistor | | 10kΩ |
| 152 | Resistor | | 1.1kΩ |
| 154 | Capacitor | | .05 μF |
| 156 | Zener Diode | 1N4744 | |
| 160 | Resistor | | 1MEG |
| 164 | Resistor | | 39kΩ |

TABLE 1-continued

| NUMBER | DEVICES | PART NO. | VALUES |
|---|---|---|---|
| 168 | Resistor | | 22kΩ |
| 170 | Capacitor | | .01 μF |
| 206 | Capacitor | | 2000 μF |
| 208 | Thermal Switch | 7AM027A5-920 | |
| 212a | Bipolar transistor | 2N3904 | |
| 212b | Bipolar transistor | 2N3906 | |
| 214 | Resistor | | 39KΩ |
| 216 | Integrated Circuit | ILM339 | |
| 222 | Capacitor | | .1 μF |
| 223 | Resistor | | 5.1kΩ |

A circuit having this configuration and receiving a 12 volt DC supply voltage $V_s$ produces threshold voltages of $V_1$=9.1 Volts DC, $V_2$=4.5 Volts DC, $V_3$=0.2 Volts DC and is capable of providing sufficient AC voltage and current to a 13 W fluorescent lamp equipped with a glow tube switch and an arc and noise suppression capacitor to start and operate the lamp in the manner previously described. The circuit 200 having the component values given by Table 1 and also having an auto-transformer which has a 39 turn primary winding 123 and a 162 turn secondary winding 121 is suitable for operating the lamp 120. Specifically, this configuration of the circuit 200 preferably provides a boosted starting voltage of 100 Volts RMS at approximately 40 kHz to the lamp 120 and preferably provides an operating voltage of 50 Volts RMS at approximately 40 kHz.

CIRCUIT CONFIGURATION FOR RAPID START TYPE LAMP

Figure 5:
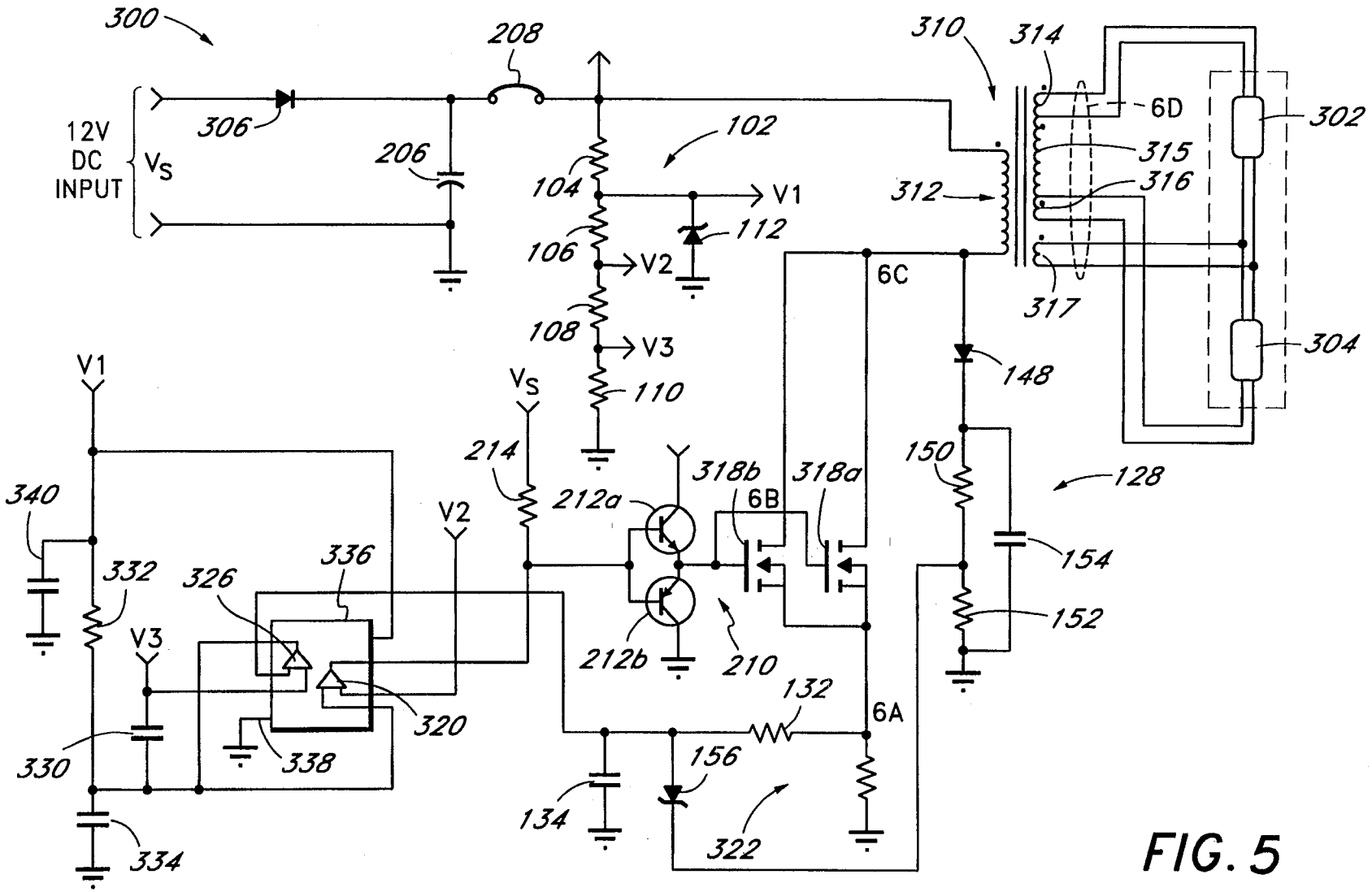
FIG. 5 is a detailed circuit schematic illustrating a control circuit of the present invention modified for use with multiple gas discharge lamps which includes circuitry for a closed-loop feedback controlled oscillator, and a closed-loop feedback controlled protective clamp circuit.

The circuits 100 and 200 can be easily modified so that they can be used with different types and configurations of gas discharge lamps while still using the basic circuit configuration and providing the same operational advantages. As an example, FIG. 5 illustrates a control circuit 300 which represents a modification of the circuit 200 shown in FIG. 3. The circuit 300 is configured to be used with two rapid start type low wattage fluorescent lamps 302, 304 having filaments connected to the lamp electrodes, such as DULUX-S-E lamps manufactured by Oshram Corporation of New York, which are connected in series. The lamps 302 and 304 in this embodiment do not have glow tube switches or arc and noise suppression capacitors so that the boost circuit 158 used to provide a higher starting voltage to the lamp 120 shown in FIG. 1 is not needed in circuit 300. In most other respects however, the operation and configuration of the control circuit 300 is the same as the operation and configuration of the control circuit 100.

The circuit 300 receives the DC input voltage $V_s$, which is preferably 12 Volt DC, but can be any voltage within the range of 9 to 14 volts from an external voltage supply (not shown). This voltage is fed through a diode 306, the filter capacitor 206 and the thermal switch 208 to the voltage divider network 102. Instead of using an auto-transformer 116 as the circuit's inductive coupling device, the circuit 300 instead uses a transformer 310 where the DC input voltage $V_s$ is provided to a primary winding 312 and the lamps 302 are connected to a first, second, third and fourth secondary windings 314, 315, 316 and 317. The lamps 302 are connected in series across the second secondary winding 315 in the manner shown and the first, third and fourth secondary windings 314, 316, 317 respectively provide current for the filaments in the rapid start lamps 302.

The circuit 300 also includes the protective clamp circuit 128 which protects the components of the circuit 300 from large voltages such as those generated when one of the lamps 302 has been removed from the circuit 300. The operation and components of the clamp circuit 128 in the control circuit 300 are substantially similar to the operation and components of the clamp circuit 128 previously described in reference to FIGS. 1 and 4, respectively.

Further, the circuit 300 includes a switching transistor arrangement which is driven by a comparator in a fashion substantially similar to the circuit shown in FIGS. 1 and 3, however the switching transistor arrangement is slightly modified for this application. Specifically, the switching transistor arrangement in the circuit 300 preferably consists of two power MOSFET transistors 318*a* and 318*b* having common gates, drains and sources. The common drains of the switching transistors 318 are connected to the second leg of the primary winding 312 of the transformer 310, and the common bases of the switching transistors 318 are connected to an emitter-follower pair 210 which receives the output signal of a buffer comparator 320 in substantially the same manner that was described previously in reference to the circuit 200 shown in FIG. 4.

The common sources of the switching transistors 318 are connected to a current sensor 322 having substantially the same configuration and operation as the current sensor 129 described in reference to FIGS. 1 and 2 above. The current sensor 322 thus includes the capacitor 134, the resistor 132 and a resistor 324. The capacitor 134 is connected to the inverting (−) input of a comparator 326. The non-inverting (+) input of the comparator 326 is connected to the reference voltage $V_3$. Further, the output of the comparator 326 is fed back to the non-inverting (+) input of the comparator 326 through a hysteresis loop which includes a capacitor 330. The output of the comparator 326 is also connected to the reference voltage $V_1$ from the voltage divider network 102 through a resistor 332 and to ground through a capacitor 334. Further, the output of the comparator 326 is provided to the non-inverting (+) input of the buffer comparator 320.

The comparators 320 and 326 are preferably provided by an integrated circuit 336, such as a commercially available type LM 393 integrated circuit. The integrated circuit 336 includes a ground connection 338 and is connected to the reference voltage $V_1$ in the voltage divider network 102 and to ground through a capacitor 340.

The most significant difference between the circuit 300 shown in FIG. 4 and the circuit 100 shown in FIG. 1, is the absence of the boost feedback circuit 158 in the circuit 300. In this application, where two rapid start lamps 302 are connected in series, the component values and the turns ratio of the transformer 310 can be selected so that sufficient high frequency alternating voltage can be provided to start the lamps 302.

OPERATION OF THE CIRCUIT CONFIGURATION FOR RAPID START TYPE LAMPS

Figure 6:
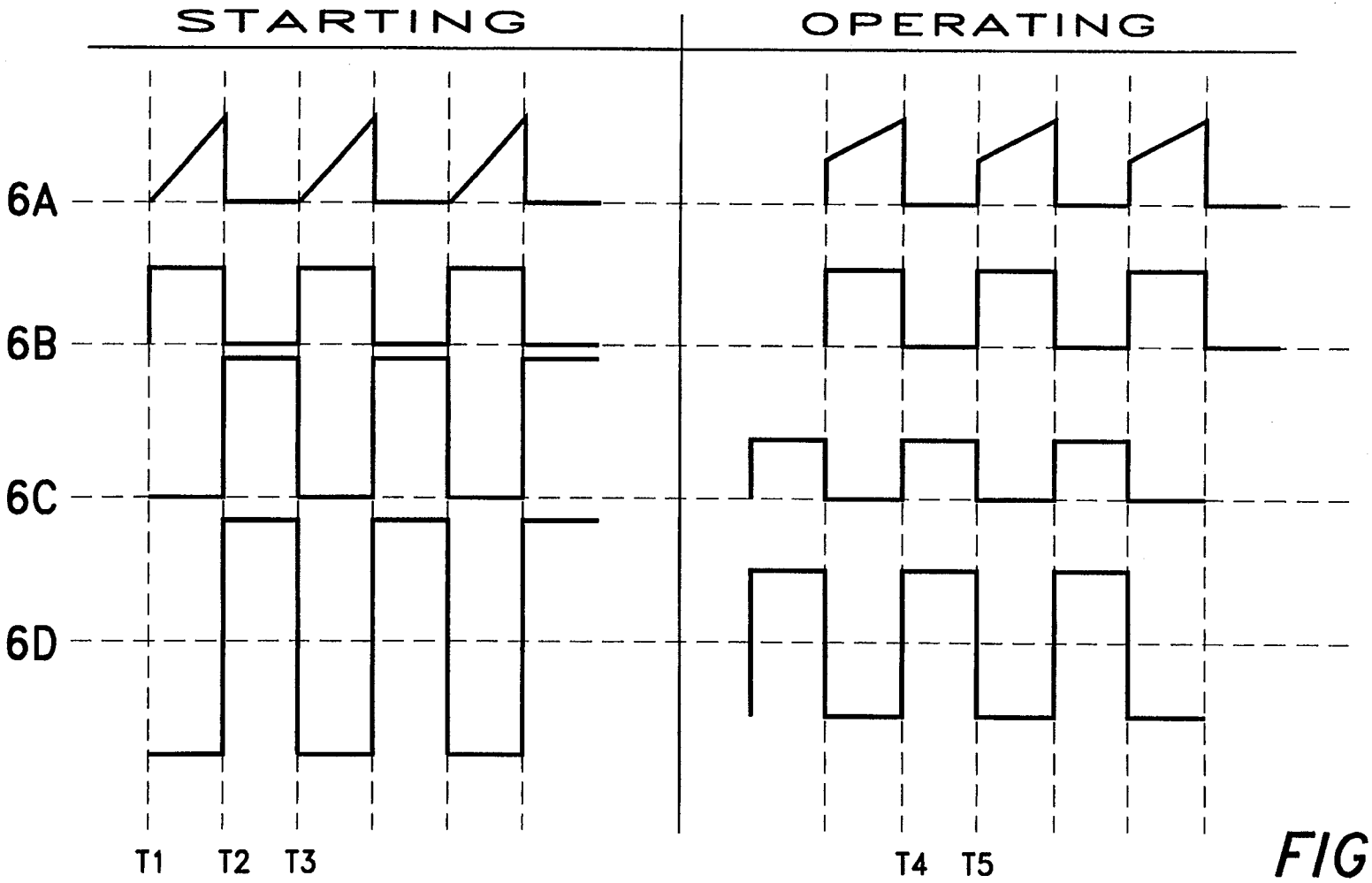
FIG. 6 shows four waveform plots labeled 6A, 6B, 6C and 6D, which are characteristic of the control circuit shown in FIG. 5 and which are used to illustrate the operation of the control circuit when it is both a starting mode and an operating mode.

A comparison of the waveforms of FIG. 6 to the waveforms of FIG. 2 illustrates that the operation of the circuit 300 is nearly identical to the operation of the circuit 100 with the absence of the effects caused by the boost feedback circuit 158 in circuit 100. FIG. 6 has four exemplary waveforms illustrating the voltage and current signals over time as seen at various points in the circuit 300 when the circuit 300 is initially in the starting mode and then subsequently in the operating mode, vertically juxtaposed and sharing a common time line. Specifically, waveform 6A illustrates the waveform of the current signal received by the current sensor 322 at the source of the switching transistors 318. Waveform 6B illustrates the voltage signal applied by the comparator 326 through the buffer comparator 322 to the common gate of the switching transistors 318. Waveform 6C illustrates the resulting voltage signal seen on the drain of the switching transistors 318. Finally, waveform 6D illustrates the resulting voltage signal that is applied across the windings of the transformer 310 to the lamps 302.

When the circuit 300 is in the starting mode, the comparator 326, through the buffer comparator 320, initially turns the switching transistors 318 on at a time $T_1$, permitting current to flow through the primary winding 312 of the transformer 310 and the current sensor 322. This current ramps upward, as shown in waveform 6A, until it builds a sufficient voltage at a time $T_2$ on the capacitor 134 to cause the comparator 326 to output a low signal, shown in waveform 6B, thereby turning the switching transistors 318 off. While the current is flowing through the primary winding 312 of the transformer 310 between time $T_1$ and $T_2$, the voltage applied to the lamps 302, 304 is negative, as shown in waveform 6D. Further, between times $T_1$ and $T_2$ energy is stored in the primary winding 312 of the transformer 310 and, when the switching transistors 318 are turned off at time $T_2$, the transformer 310 enters the fly-back mode. In the fly-back mode, the stored energy in the primary winding 312 is discharged to the first and second secondary windings 314 and 316 of the transformer 310 respectively. Consequently, as shown in waveform 6D, a positive voltage is then applied at time $T_2$ to the lamps 302, 304 and the lamps 302, 304 continue to receive this voltage until the hysteresis loop of the comparator 326 causes the comparator 326 to output a high signal thereby turning the switching transistors 318 back on at time $T_3$. At time $T_3$, the voltage applied to the lamps 302, 304 returns to a negative voltage and this cycle is repeated until both of the lamps 302,304 are started. Once both lamps 302,304 are started, the circuit 300 initiates an operating or feed forward mode.

In the operating mode, the switching transistors 318 continue to be switched by the comparator 326 and the capacitor 134 in the above described fashion as is illustrated by waveforms 6A and 6B. The voltage applied to the lamps 302, 304 is thus an alternating voltage where the lamps 302, 304 receive a positive voltage each time the switching transistors 318 turn off, e.g., at time $T_4$, forcing transformer 310 into the fly-back mode where stored energy in the primary winding 312 is discharge through the secondary windings 314 and 316 to the lamps 302, 304 until the transistors 318 are turned back on, e.g., at time $T_5$. In this fashion, a high frequency alternating voltage is applied to the electrodes of the lamps 302, 304 which reduces wear and deterioration on the electrodes and thereby lengthens the operational life of the lamps 302, 304.

The amplitude of the voltage applied to the lamps 302, 304 when the circuit 300 is in the operating mode is less than the amplitude of the voltage applied to the lamps 302, 304 when the circuit 300 is in the starting mode as can be seen from waveform 6D. When the circuit 300 is in the starting mode, the lamps 302, 304 draw no current, however, when the circuit is in the operating mode, the lamps 302,304 have an effective negative resistance and draw a large amount of current reducing the voltage signal at the lamps 302,304. Further, because the lamps 302,304 have this low or negative resistance when they are operating, the current through the source of the transistors when the transformer 310 is in fly-back mode between times $T_4$ and $T_5$ is as shown in waveform 6C.

One preferred implementation of the above-described circuit 300 which operates in the above-described manner, consists of the circuit configuration shown in FIG. 4 with component values as given by Table 2 below.

TABLE 2

| NUMBER | DEVICES | PART NO. | VALUES |
|---|---|---|---|
| 104 | Resistor | | 220Ω |
| 106 | Resistor | | 15kΩ |
| 108 | Resistor | | 15kΩ |
| 110 | Resistor | | 820Ω |
| 112 | Zener Diode | 1N4739 | |
| 132 | Resistor | | 200 |
| 134 | Capacitor | | .01 μF |
| 148 | Diode | 1N4936 | |
| 150 | Resistor | | 10kΩ |
| 152 | Resistor | | 1.1kΩ |
| 154 | Capacitor | | .05 μF |
| 156 | Zener Diode | 1N4744 | |
| 206 | Capacitor | | 2000 μF |
| 208 | Thermal Switch | 7AM027A5-920 | |
| 212a | Bipolar transistor | 2N3904 | |
| 212b | Bipolar transistor | 2N3906 | |
| 214 | Resistor | | 39KΩ |
| 306 | Diode | IN5822 | |
| 318a | Switching transistor | IRF640 | |
| 318b | Switching transistor | IRF640 | |
| 324 | Resistor | | .05Ω |
| 330 | Capacitor | | 100 μF |
| 332 | Resistor | | 12K |
| 334 | Capacitor | | 1nF |
| 336 | Integrated circuit | LM393 | |
| 340 | Capacitor | | .1 μF |

The circuit 300 with the configuration shown in FIG. 5 and the component values listed in Table 2 above, operates in the manner previously described in reference to the exemplary waveforms of FIG. 6. The circuit 300 having the component values given by Table 2 and where the primary winding 312 of the transformer 310 has 29 turns, the first, third and fourth secondary windings 314, 316 and 317 each have 10 turns, and the second secondary winding 315 has 180 turns is suitable for operating the lamps 302, 304. Specifically, this configuration of the circuit 200 preferably provides a starting voltage of 100 Volts RMS at approximately 40 kHz to start the lamps 302, 304 and then provides 50 Volts RMS to operate the lamps 302, 304 once they have started.

SUMMARY

The foregoing description has described and explained several configurations of the control circuit for low wattage gas discharge lamps of the present invention. The foregoing description has also illustrated the advantageous features of the present invention including using feedback of both the current flowing through the inductive coupling element and through the gas discharge lamp to supply an appropriate voltage to the lamp and provide protection for the circuit.

Specifically, the foregoing description provides a control circuit which uses closed-loop feedback in conjunction with an inexpensive switching transistor and a comparator to provide an alternating high voltage, high frequency voltage signal to the lamps. This alternating high voltage, high frequency signal is formulated to eliminate the need for external ballasting elements in the control circuit and it also reduces deterioration on the lamp electrodes thereby prolonging the life of the lamps.

The foregoing description has also described a control circuit which uses feedback of the voltage applied to the lamp, in conjunction with an additional comparator, to supply a boosted voltage to the lamp when the lamp is being started. Once the lamp has started, the control circuit then supplies a lower voltage which results in less drain on the external voltage supply. This feature enables the control circuit to be used in conjunction with currently available pre-heat lamps equipped with an arc and noise suppression capacitor and a glow tube switch which are typically operated at lower frequencies.

Further, the control circuit of the present invention also incorporates a protective clamp circuit which samples the voltage produced during fly-back of the inductive coupling device to sense when this voltage is approaching dangerous levels, as, for example, when the lamp has been either destroyed or removed when the control circuit is in operation. The protective clamp circuit operates in conjunction with a comparator to clamp the energy stored in the primary winding of the inductive coupling device so that the resulting voltage is at a safe level.

Although the above detailed description has shown, described and pointed out fundamental novel features of the invention as applied to the various embodiments discussed above, it will be understood that various omissions and substitutions and changes in the form and details of the device illustrated may be made by those skilled in the art, without departing from the spirit of the invention. The described embodiments are to be considered in all respects only as illustrative and not restrictive. The scope of the invention is, therefore, indicated by the appended claims rather than the foregoing description. All changes which come within the meaning and range of equivalency of the claims are to be embraced within their scope.

What is claimed is:

1. A circuit for energizing a gas discharge lamp comprising:

an inductive coupling device receiving an input supply current and providing an alternating voltage signal to said gas discharge lamp;

a switching device alternately (a) supplying current from said input supply to said inductive coupling device to store energy in said inductive coupling device and thereby applying a voltage of a first polarity to said lamp, and (b) interrupting current from said input supply to said inductive coupling device to drive said inductive coupling device into a fly-back mode wherein said stored energy applies a voltage of a second polarity to said lamp;

a current sensor producing a first signal indicative of said current supplied to said inductive coupling device by said switching device; and a switch driving circuit, responsive to said first signal from said current sensor, to cause said switching device to interrupt current to said inductive coupling device for a period of time in response to said first signal reaching a first threshold level.

2. The circuit of claim 1, wherein said circuit receives a direct current supply voltage in the range of 9 to 14 volts.

3. The circuit of claim 1 further comprising a rectifier circuit receiving a voltage from an external supply and providing said input supply current to said inductive coupling device.

4. The circuit of claim 1, further comprising a thermal switch operably engaged to said inductive coupling device so that when the temperature of said circuit exceeds a pre-selected value, said thermal switch removes said input supply current from said circuit.

5. The circuit of claim 1, wherein said inductive coupling device comprises an auto-transformer having a primary winding connected to said switching device which stores energy at a rate in proportion to said current flowing through said primary winding, a tap receiving said input supply current and a secondary winding connected to said lamp.

6. The circuit of claim 5, wherein said auto-transformer applies an alternating voltage to said lamp, said alternating voltage having a first polarity when said switching device supplies current to said primary winding and said alternating voltage having a second polarity when said switching device interrupts current to said primary winding.

7. The circuit of claim 1, wherein said switching device comprises a MOSFET transistor having a drain connected to said inductive coupling device, a source connected to said current sensor, and a base responsive to said switch driving circuit.

8. The circuit of claim 1, wherein said switch driving circuit comprises a comparator having a threshold input receiving a reference signal and a first input receiving said first signal from said current sensor, said comparator causing said switching device to interrupt current to said inductive coupling device in response to said first signal exceeding said reference signal.

9. The circuit of claim 1, wherein said switch driving circuit comprises a hysterisis loop which causes said switching device to interrupt current to said inductive coupling device for said period of time.

10. The circuit of claim 1, further comprising a protective clamp circuit receiving a signal indicative of the fly-back voltage occurring when said inductive coupling device is in said fly-back mode, which produces a control signal to control said switch driving circuit when said fly-back voltage exceeds a pre-selected threshold value.

11. The circuit of claim 10, wherein said switch driving circuit is also responsive to said control signal from said protective clamp circuit so that said switch driving circuit induces said switching device to interrupt current to said inductive coupling device in response to the sum of said first signal and said control signal exceeding said reference signal provided to said threshold input.

12. The circuit of claim 1, further comprising a boost feedback circuit which samples the voltage applied to said lamp and induces said switch driving circuit to cause said switching device to supply current to said inductive coupling device for an extended period of time to permit energy to be stored in said inductive coupling device to start said lamp.

13. The circuit of claim 12, wherein said lamp is a pre-heat type low wattage fluorescent lamp and said circuit provides said alternating voltage signal at an amplitude substantially equal to 100 volts RMS and a frequency substantially equal to 40 kHz to said lamp when said lamp has not started and said circuit provides said alternative voltage signal at an amplitude substantially equal to 50 volts RMS and a frequency substantially equal to 40 kHz when said lamp has started.

14. The circuit of claim 1, wherein said circuit is configured to start and operate two rapid start type fluorescent lamps.

15. The circuit of claim 14 wherein said inductive coupling device is a transformer having a primary winding connected to said switching device and to a power source providing an input supply current, and said transformer also having a secondary winding connected to said lamp, wherein said primary winding stores said stored energy at a rate in proportion to said current flowing through said primary winding.

16. The circuit of claim 15, wherein said switching device is comprised of a pair of MOSFET transistors having a common drain connected to said primary winding of said transformer, a common source connected to said current sensor, and a base responsive to said switch driving circuit.

17. A circuit for energizing a gas discharge lamp comprising:

inductive coupling means for providing said gas discharge lamp an alternating voltage sufficient to both start and operate said lamp;

switching means for switching said inductive coupling means to alternately store energy therein and to apply the stored energy to said lamp for a period of time;

current sensor means for producing a first signal indicative of said energy stored in said inductive coupling means; and comparing means, operably engaged with said switching means and receiving said first signal, for driving said switching means to switch said inductive coupling means to apply stored energy to said lamp for said period of time.

18. The circuit of claim 17, further comprising a voltage limiting means for limiting the voltage in said circuit to a pre-selected maximum to thereby protect said circuit from damage due to excessive voltages.

19. The circuit of claim 18, wherein said voltage limiting means is comprised of a circuit which provides a signal to said comparing means causing said comparing means to drive said switching means to switch said inductive coupling device to apply said stored energy to said lamp.

20. The circuit of claim 17, further comprising boost means for increasing the voltage applied to said lamp when said lamp has not been started.

21. The circuit of claim 20 wherein said boost means is comprised of a circuit which delays operation of said comparing means in driving said switching means to switch said inductive coupling device to apply said stored energy to said lamp.

22. The circuit of claim 17, wherein said inductive coupling means comprises a transformer having a primary winding connected to said switching means and a secondary winding connected to said lamp.

23. The circuit of claim 17, wherein said switching means is comprised of at least one MOSFET transistor.

24. The circuit of claim 17, wherein said comparing means is comprised of a comparator circuit having a threshold input receiving a reference signal and a switching input receiving said first signal from said current sensor means.

25. The circuit of claim 24, wherein said comparator circuit drives switching means to switch said inductive coupling device to apply said stored energy when said switching input receives a first signal which exceeds said reference signal.

26. A circuit for energizing and controlling a pre-heat type gas discharge lamp comprised of:

an inductive coupling device having a primary winding and a secondary winding where said primary winding receives a supply voltage and said secondary winding provides an alternating voltage to said lamp;

a switching transistor connected to said primary winding so that when said switching transistor is conductive, current flows through said primary winding causing energy to be stored therein, and when said switching transistor is nonconductive, said inductive coupling device operates in a fly-back mode where energy stored in said primary winding is applied to said lamp;

a current sensor circuit receiving a signal indicative of said current in said primary winding when said switching transistor is conductive and producing a first signal indicative of said current;

a comparator having a reference input receiving a threshold signal and a switching input receiving said first signal, operably engaged with said switching transistor so that when said switching input receives a signal greater than said threshold signal received by said reference input, said comparator drives said switching transistor to become nonconductive for a period of time; and a boost circuit which increases said threshold signal and causes said switching transistor to remain conductive for an extended period of time so that, when said switching transistor becomes nonconductive and said inductive coupling device enters said fly-back mode, a voltage sufficient to start said lamp is applied to said lamp.

27. The circuit of claim 33, further comprising a voltage limiting circuit receiving a signal indicative of the voltage produced by said inductive coupling device which limits the voltage produced when said inductive coupling device enters said fly-back mode to a maximum threshold voltage.

28. A circuit for energizing a gas discharge lamp comprising:

an inductive coupling device receiving an input supply current and providing an alternating voltage signal to said gas discharge lamp;

a switching device alternately (a) supplying current from said input supply to said inductive coupling device to store energy in said inductive coupling device and thereby applying a voltage of a first polarity to said lamp, and (b) interrupting current from said input supply to said inductive coupling device to drive said inductive coupling device into a fly-back mode wherein said stored energy applies a voltage of a second polarity to said lamp;

a protective clamp circuit receiving a signal indicative of a fly-back voltage occurring when said inductive coupling device is in said fly-back mode, and producing a control signal; and a switch driving circuit, responsive to said control signal from said protective clamp circuit, to cause said switching device to interrupt current to said inductive coupling device for a period of time in response to said fly-back voltage exceeding a pre-selected threshold value.

29. The circuit of claim 28, wherein said pre-selected threshold value is selected to provide protection for the components of said circuit from excessive voltages.

30. The circuit of claim 28, further comprising a current sensor producing a first signal indicative of said current supplied to said inductive coupling device by said switching device.

31. The circuit of claim 30, wherein switch driving circuit is responsive to both said control signal and said first signal, so that said switch driving circuit causes said switching device to interrupt current to said inductive coupling device for a period of time in response to the sum of said first signal and said control signal reaching a first threshold level.

32. The circuit of claim 28, further comprising a boost feedback circuit which samples the voltage applied to said lamp and which induces said switch driving circuit to cause said switching device to supply current to said inductive coupling device for an extended period of time to permit energy to be stored in said inductive coupling device to start said lamp.

33. A circuit for energizing a gas discharge lamp comprising:

an inductive coupling device receiving an input supply current and providing an alternating voltage signal to said gas discharge lamp;

a switching device alternately (a) supplying current from said input supply to said inductive coupling device to store energy in said inductive coupling device and thereby applying a voltage of a first polarity to said lamp, and (b) interrupting current from said input supply to said inductive coupling device to drive said inductive coupling device into a fly-back mode wherein said stored energy applies a voltage of a second polarity to said lamp;

a boost feedback circuit which samples the voltage applied to said lamp and produces a control signal when said lamp has not started; and a switch driving circuit, responsive to said control signal from said boost feedback circuit, which induces said switching device to supply current from said input supply to said inductive coupling device for an extended period of time to permit energy to be stored in said inductive coupling device to start said lamp.

34. The circuit of claim 33, further comprising a current sensor producing a first signal indicative of said current supplied to said inductive coupling device by said switching device.

35. The circuit of claim 34, wherein said switch driving circuit is also responsive to said first signal, and said switch driving circuit causes said switching device to interrupt current to said inductive coupling device for a period of time in response to said first signal reaching a first threshold level.

36. The circuit of claim 33, further comprising a protective clamp circuit receiving a signal indicative of a fly-back voltage occurring when said inductive coupling device is in said fly-back mode, which produces a control signal.

37. A method of controlling and energizing a gas discharge lamp by providing an alternating voltage to said lamps using a circuit including a inductive coupling device, a switching device and a current sensing device comprising the steps of:

coupling said gas discharge lamp to a source of electrical power through said inductive coupling device;

charging said inductive coupling device by permitting current to flow from said source of electrical power through said switching device to said inductive coupling device;

sensing the current flowing through said of inductive coupling device;

interrupting current through said inductive coupling device from said source of electrical power to cause said inductive coupling device to enter a fly-back mode and to apply energy to said lamp when said current is greater than a first threshold level;

sensing the voltage at said lamp; and limiting the charging of said inductive coupling device in response to said sensed voltage.

38. The method according to claim 37, further comprising the step of:

increasing said charging of said inductive coupling device in response to a sensed voltage which indicates that said lamp has not started.

* * * * *